United States Patent [19]

Obolensky

[11] 4,070,061

[45] Jan. 24, 1978

[54] METHOD AND APPARATUS FOR COLLECTING MINERAL AGGREGATES FROM SEA BEDS

[75] Inventor: Vsevolod Obolensky, Brussels, Belgium

[73] Assignee: Union Miniere, Brussels, Belgium

[21] Appl. No.: 703,880

[22] Filed: July 9, 1976

[51] Int. Cl.[2] ..... E02F 7/00

[52] U.S. Cl. ..... 299/8; 37/DIG. 8; 37/61

[58] Field of Search ..... 299/8; 37/DIG. 8

[56] References Cited

U.S. PATENT DOCUMENTS

| | | | |
|---|---|---|---|
| 3,588,174 | 6/1971 | Rossfelder | 299/8 |
| 3,802,740 | 4/1974 | Sullivan | 299/8 |
| 3,975,054 | 8/1976 | Brockett et al. | 299/8 |

*Primary Examiner*—Ernest R. Purser

*Attorney, Agent, or Firm*—Pollock, Vande Sande & Priddy

[57] ABSTRACT

A dragged or self-propelled unit has drag shoes or other means to dislodge nodules from the sea bed into a duct which may be associated with nozzles to project fluid against the nodules. The duct increases substantially in cross-section, thereby slowing the velocity of a stream formed by the nodules, accompanying silt and water. The slowed nodules and silt are caused to follow divergent separate paths within the unit, the nodule path being relatively below the silt path, and the nodules are removed from the duct upstream of the final outlet by which silt and water depart the unit.

48 Claims, 4 Drawing Figures

FIG. 1
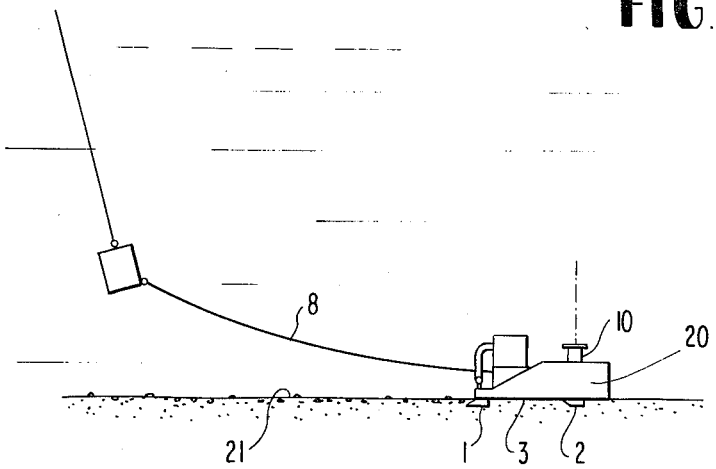
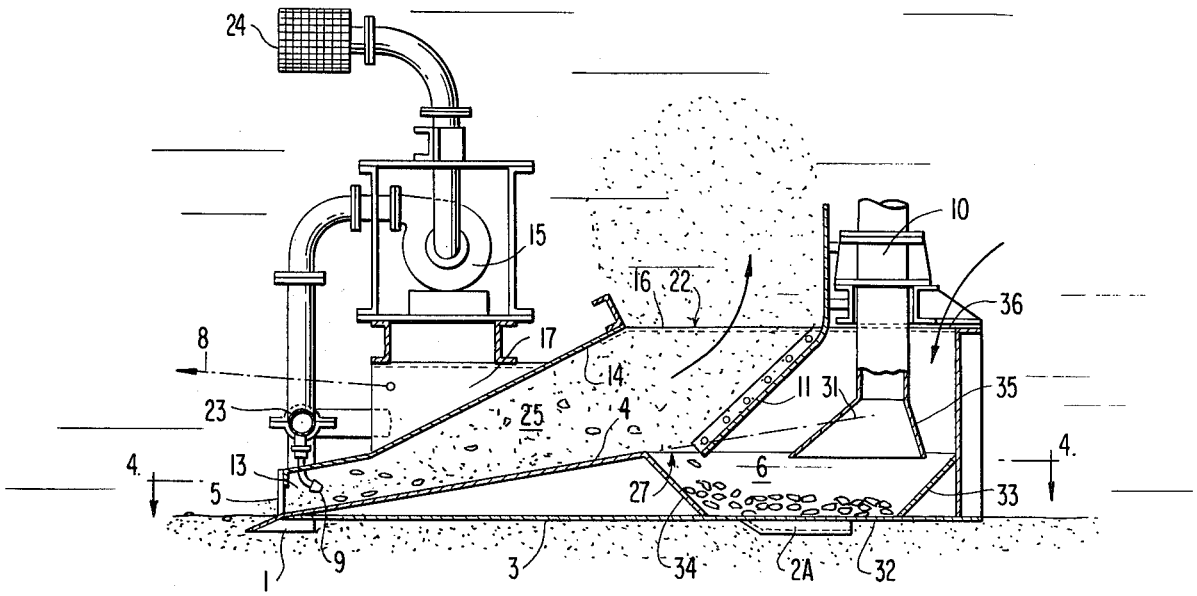
FIG. 2

METHOD AND APPARATUS FOR COLLECTING MINERAL AGGREGATES FROM SEA BEDS

BACKGROUND OF THE INVENTION

Many unsuccessful attempts have been made to discover workable methods and apparatus for gathering metal nodules from layers of silt at the surface of the sea bed. Nodules, containing such industrially significant metals as manganese, copper, cobalt, nickel, zinc, vanadium, and others, are generally found in the silt layer quite close to the silt/water interface. The silt is generally red clay or silicious or calcareous ooze, and usually has a sticky or adhesive character. The great depths of the water under which the nodule-bearing silt layers exist indicate the desirability of remote controlled, mechanized gathering techniques and apparatus. However, difficulties have been experienced not only with the plugging or blocking of such apparatus by sticky masses of silt and nodules, but also with inadequate removal of stubbornly adherent silt from the nodules. Some of the means heretofore suggested for overcoming these problems introduce exaggerated power requirements which, under present conditions, are economically impracticable. Thus, a need remains for improvements in methods and apparatus for gathering and cleaning metal nodules from the sea bed.

SUMMARY OF THE INVENTION

The present invention provides methods and apparatus for collecting mineral aggregates from sea beds, which are both technically and economically practicable and which are not subject to the foregoing difficulties. The apparatus of the invention is a unit which includes means to transport it across and to support it at the surface of the sea bed. The unit also includes means for dislodging aggregates and accompanying silt from the sea bed. Adjacent the dislodging means is an inlet leading into a duct including a slowing passage which undergoes a substantial increase in cross sectional area in the "downstream" direction, i.e. the direction in which nodules, silt and water pass through the duct. Means are provided downstream of the slowing passage for separating nodules from the aforementioned stream, such means acting to cause divergence of silt and nodules into separate paths in which the nodule path is relatively below the silt path. Means are provided for causing the nodules to depart from the duct upstream of the final outlet by which silt and water depart the unit.

In accordance with a method aspect of the invention, a means for dislodging aggregates and accompanying silt is caused to traverse the sea bed. A stream of nodules and silt dislodged thereby, and water, is introduced into a duct which undergoes a substantial increase in cross sectional area in the downstream direction. The velocity of the stream is slowed substantially by passing it downstream in said duct. Nodules are separated from the slowed stream by causing divergence of silt and nodules into separate paths in which the nodule path is relatively below the silt path. The nodules are caused to depart from the duct upstream of the final outlet for silt and water.

If the means for dislodging aggregates and accompanying silt is a cutting device, such as one or more drag shoes which penetrate the sea bed, and the unit is in contact with the sea bed through a substantially flat undersurface of sufficient area in relation to over-all unit weight, the under-surface will resist sinking into the silt. This provides control over the depth of penetration of the drag shoes, affording opportunity for meaningful control over the depth of cut by substituting drag shoes of differing height as appropriate for the extent of protrusion of the nodules into the sea bed.

Certain preferred aspects of the aforementioned apparatus and method constitute additional inventions, such being described in the accompanying drawings, and in the remainder of the specification.

BRIEF DESCRIPTION OF THE DRAWINGS

FIG. 1 is a diagram of the sea bed in vertical section with a schematic side elevation of the apparatus of the invention.

FIG. 2 is a vertical section of the apparatus in FIG. 1 taken along section line 2—2 in FIG. 4.

DESCRIPTION OF VARIOUS EMBODIMENTS

Figure 3:
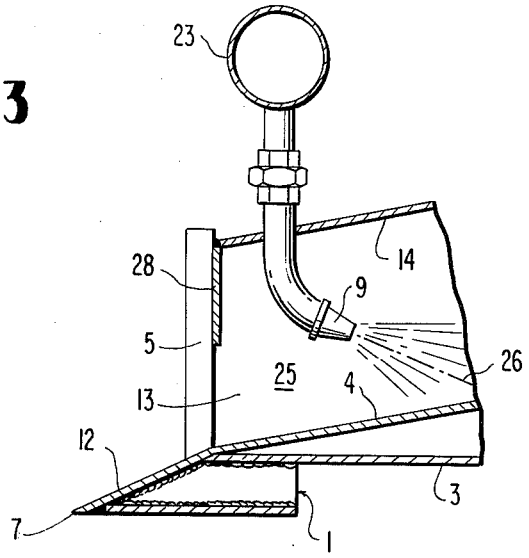
FIG. 3 is an enlarged portion of the inlet end of the apparatus of FIG. 2.

The nature of the invention is not dependent upon the exact details of the supporting and transporting means. Virtually any suitable means may be used to support the unit at the surface of the sea bed. For instance, the unit may be supported on movable tracks, for instance of the type used on a bulldozer, or on a simple skid or sled arrangement. However, the presently preferred embodiment of unit 20 shown in FIGS. 1 and 2 utilizes its flat undersurface 3 to support itself on the sea bed 21. Motive power may be provided by a motor on the unit itself or by a cable or reinforced hose connected to a vessel which pulls the unit across the bottom. The present embodiment is caused to slide along the sea bed on undersurface 3 by a pull cable 8, one end of which is attached to the unit, and the other end of which is attached to a vessel, floating stage or the like, which is not shown.

The cable 8 may, for instance, be attached to the unit ahead of its center of gravity, for example to pump support frame 17. Any number of drag shoes such as 2A and 2B, shown in FIGS. 2 and 4, may be affixed to the undersurface 3 behind the center of gravity of the unit. As the device is dragged across the bottom, they will cut into and plow through the surface layer of the sea bed, exerting downward force on the rearward half of subsurface 3 which helps maintain the apparatus in a horizontal position.

Maintenance of substantially horizontal contact between undersurface 3 and the sea bed may also be assisted by one or more drag shoes 1 which are located forward of the center of gravity of the unit and, preferably, constitute the leading edge thereof. As the unit passes over the seabottom, drag shoes 1 also cut into and plow through the surface of the sea bed. However, it should be understood that it is within the scope of the invention to provide a wide variety of means other than drag shoes 1 and 2 for maintaining the orientation of the unit relative to the sea bed.

In accordance with the present preferred embodiment of the invention, the drag shoe or shoes forward of the center of gravity of the unit also dislodge nodules and silt from the sea bed which are then taken into the unit. The enlarged view in FIG. 3 depicts the preferred drag shoe 1, which has a chamfered or bevelled forward edge 7 and is positioned on the housing in fixed or adjustable relationship so that said edge runs along in the sea bed at least just below the center of gravity of the nodules to be collected. The upper surface 12 of the drag shoe extends rearwardly of said edge and inclines upwardly and rearwardly to form an inclined surface which can lift the nodules from sea bed 21 as the unit moves forward. Preferably, the drag shoe extends across the entire width of the front of the unit, or at least the entire width of the inlet to be described below. It is particularly convenient if the drag shoe is arranged to be removable. This enables drag shoes of different heights to be substituted, enabling one to regulate the depth to which the drag shoe penetrates the sea bed, whereby the penetration may be made to correspond to the mean diameter of the nodules which it is desired to collect.

The device may include any suitable means for preventing the entry of oversized materials, including oversized nodules, slabs, large rocks, debris and the like. Such means are known and may take any desired form. However, in the present embodiment it is a grid of vertical bars 5 located at the rear of upper surface 12 of drag shoe 1, in position to receive material elevated by the drag shoe. The grid bars are situated at suitable lateral distances across the entire width of the inlet 13 by which nodules of the proper size may enter the housing.

Figure 4:
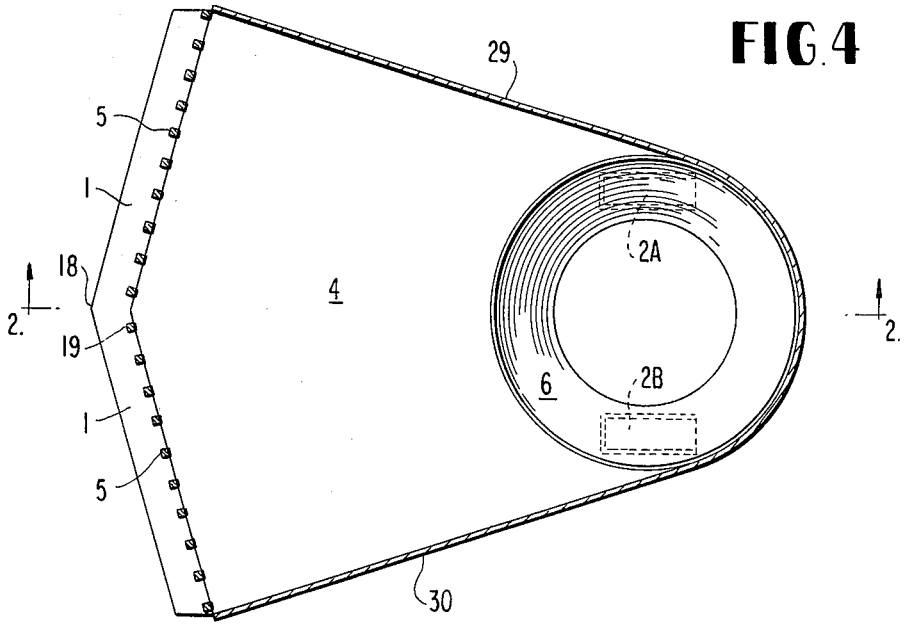
FIG. 4 is a horizontal section through the apparatus of FIG. 2, taken on section lines 4—4.

Preferably the aforementioned grid, and preferably also the leading edge of the drag shoe 1, taper rearwardly when viewed in a horizontal plane. The foremost projection of these components may be at one side of the apparatus, so that they taper rearwardly towards the other side of the apparatus or, as shown in the present embodiment, these components may taper outwardly and rearwardly from the center, so that their foremost projections 18 and 19 are at the center of the apparatus as shown in FIG. 4. Where sufficient taper is provided, it will increase the likelihood that oversized material will be brushed aside during the movement of the apparatus, rather than becoming lodged between individual bars 5 in the grid.

Above and behind the means for dislodging nodules from the bottom is the inlet 13. It is positioned to receive a stream of nodules, silt and water from the dislodging means into a duct 25 extending through the housing of the device. Where a bar grid or similar means is provided, this inlet is situated behind the bar grid. Any suitable form of inlet may be used. The opening may for instance be a simple rectangular opening or have convergent side wings and upper extensions to assist in funneling dislodged material into the inlet. However, in the present embodiment, the inlet 13 is tapered to correspond with the taper of the bar grid.

The velocity of the aforementioned stream is in part a result of the motion of the unit itself through the water. However, according to a preferred aspect of the invention, means are provided for imparting turbulence to this stream and, if desired, increasing its velocity. Moreover, means can be provided for regulating the turbulence or added velocity imparted to the stream. It is possible to construct embodiments of the invention without using such means. However, the benefits realized from having them are substantial.

The means for increasing stream turbulence may include, for instance, mechanical mixing members situated in the path of said stream. However, according to a preferred embodiment, fluid agitating and propelling means are provided. Such means may be in the form of nozzles for directing water into the stream, and the unit operates quite well with water even when no gases are supplied. Accordingly, in the present preferred embodiment a series of water nozzles 9 is provided within the housing at spaced intervals across the width of inlet 13. The nozzle center-lines are preferably directed so that their discharge is at an angle converging with the lower wall of the duct 25. The nozzles are supplied by a header 23 connected to the outlet of an electric or hydraulic motor-driven pump 15 mounted on a supporting frame 17 secured to the exterior of the housing. The pump is supplied from the surrounding water through a screened intake 24, which is preferably located at sufficient height so that it remains in clear water. The flow from the nozzles, and therefore the turbulence and added velocity imparted to the stream of nodules, silt, and water after entering inlet 13, may be regulated by varying the speed of pump 15, such as by control means (not shown) extending from the unit to the surface ship.

The nozzles 9 can be located outside the duct 25 with their outlets being located at or outside the inlet 13 and directed into the inlet. This may improve the efficiency with which the nozzles 9 increase the velocity of the stream of nodules, silt, and water entering the inlet 13. However, it is a preferred aspect of the present invention that an upper portion of the inlet end of the duct 25 is closed off by a transverse member or plate 28, the nozzles 9 being situated behind and protected by such plate within duct 25, so that they will receive less wear by attrition from the nodules.

The jetting action of the aforementioned nozzles introduces turbulent motion into the stream, thereby tending to wash the silt away from the nodules. Moreover, it increases the velocity of the stream, thereby assisting in drawing nodules into the inlet 13, moving them downstream in the housing and projecting them into a nodule outlet to be described below. The nodules collected from a given area of the sea bed will be in a range or assortment of sizes, and persons skilled in the art will readily select the requisite amount of flow to be delivered through said nozzles to provide effective turbulent washing and adequate projection of the largest nodules over a sufficient distance to reach the nodule outlet.

The duct 25, entry to which is obtained through inlet 13, extends through the housing of the device. This duct includes a slowing passage, a separation zone, a nodule outlet 27 and a final outlet 22 for water and silt.

The portion of the duct referred to as the slowing passage extends downstream of the inlet 13 and continues at least to the nodule outlet 27. Extending "downstream of the inlet" means that the slowing passage may begin at the inlet or at a point downstream of the inlet and extend downstream from the inlet or said point. Thus, the inlet may open into the slowing passage either directly or indirectly, e.g. through an intervening passage. Continuing "at least to the nodule outlet" means that the slowing passage may extend to the vicinity of the nodule outlet, which is downstream of the inlet, or to a point beyond said outlet.

The slowing passage is characterized by a substantially increased cross-sectional area at its downstream end, as compared to its upstream end. The cross-sectional area may increase over all or a portion of the length of the slowing passage, in a linear or non-linear mode. However, it is preferred that the cross-sectional area increase without significant intervening reductions and is particularly preferred that the increase be substantially continuous, best results being obtained with a linear increase. Structures of this character are less likely to induce vibration in the column of water passing through the duct, thereby reducing the potential for vibration damage to the unit and for interference with the flow through the unit and through the conduit 10 to the surface.

The increase of cross sectional area in the slowing passage substantially increases the cross sectional area of the stream of nodules, silt and water, thereby slowing its velocity through the duct, and assisting in the separation of the nodules from the silt and water. In the design of specific units, an optimum increase in cross-sectional area may be selected in relation to the properties of the silt, the size and density of the nodules and other conditions prevailing at the collection site, bearing in mind the following general relationship. In general, as the adhesiveness of the silt and the size and density of the nodules increase, it is desirable that the nodules have a higher velocity prior to slow-down.

As an illustration, consider nodules averaging about 1½ inches in diameter and having a density of about 1.9 to 2.2 grams/cm$^3$ in air, just below the surface of a sea bed formed of red clay having a density (dried) of about 1.1 to 1.3 grams/cm$^3$ in air, a grain size of about 1 to 2 microns, a high water content and a low shear strength. With the unit moving along the sea bed at about 1–3 knots, averaging about 2 knots, that portion of the average linear velocity of the stream of nodules, silt, and water entering the inlet 13 which is attributable to the motion of the device would be about 1 meter per second. The flow rate of the water emanating from nozzles 9 would be maintained at an appropriate level to add approximately 2–3 meters per second to the foregoing velocity, for a total of 3–4 meters per second, about 3 m/sec. being preferred. The increase in cross sectional area would then be such as to slow the nodules to a velocity of about 1 meter per second within the slowing passage. Thus, there preferably would be a three-fold increase in cross-section between the locus of the nozzles and the nodule removal point. Bearing in mind the general relationship given above for silt adhesivity, nodule weight and stream velocity prior to slowdown, as well as the foregoing illustration, persons skilled in the art will readily conduct simple screening tests under actual ocean-bottom conditions to determine the appropriate velocities and change in cross-sectional area.

In general, any substantial increase in area (e.g. at least about 25%) may be useful in specific circumstances, but it will be more common to provide an increase of at least about 50%, preferably at least about 100%, and most preferably at least about 200%. In terms of operability of the apparatus and process, there is no critical upper limit to the percentage increase. However, there will seldom be any economic or operational advantage in the use of an increase beyond about 800%, and increases up to about 500%, and more preferably up to about 400%, will be more common.

Although the slowing passage includes divergent wall structure for increasing its cross sectional area in the downstream direction, this does not imply that all walls of this passage must be divergent. For example, in the present preferred embodiment the side walls of the slowing passage converge in the downstream direction, but the upper and lower walls diverge sufficiently to provide a substantial over-all increase in the cross sectional area of the passage.

According to the present preferred embodiment the lower and upper walls of the flowing passage are an inclined plate 4 and an upper baffle 14 constituting the divergent walls of the slowing duct. The side walls 29 and 30 converge in the downstream direction. An outlet 22 is the final outlet through which silt and water exit the duct 22. It may, if desired, be provided with a screen 16. This outlet is also of enlarged cross-sectional area compared with the inlet, being at least about 2, more preferably at least about 3 and most preferably more than about 4 times the open area of the inlet.

Means are provided in the duct for separating nodules from the stream. Such means are situated upstream of outlet 22 but still sufficiently downstream of the inlet 13 so that they are at or beyond the point at which the substantial increase in cross sectional area occurs. Such means are adapted to cause silt and nodules to diverge into separate paths in which the nodule path is relatively below the silt path. For example, a nodule outlet 27 may be provided at the downstream end of plate 4 leading into a nodule collection chamber 6. Nodule collection chamber 6 is located behind a plate 11 constituting a further extension of the aforementioned duct.

Wall 11 is preferably at a greater angle of elevation than plate 4, relative to the horizontal, and its lower edge preferably extends below the extended surface line 31 of the slowing passage, whereby the opening of nodule outlet 27 is turned away from the path of the aforementioned stream. The nodule outlet may be turned even further away from the stream path by extending the lower edge of plate 11 still lower. However, it is not necessary that the nodule duct turn away from the stream path. Any orientation of nodule duct 27 is acceptable, provided it defines a nodule path which diverges from the path of the silt and provides effective separation. For example, the nodule path may extend rearwardly in the housing, while the water and silt path extends upwardly. Alternatively, the water and silt may be caused to flow horizontally and rearwardly while the nodules diverge downwardly, e.g. under the influence of gravity. Another possibility, which is shown in the present preferred embodiment, is for the nodule path to extend rearwardly and downwardly in the housing, while the water and silt path extends rearwardly and upwardly. It is accordingly preferred that the final outlet for the silt and water be directed upwardly from the housing.

Nodule collection and storage chamber 6 has, in this preferred embodiment, hopper-type walls 33, 34, one of which extends downwardly from nodule outlet 27 to a lower supporting surface 32 behind and/or below baffle 11. Within chamber 6, behind and/or below baffle 11, is the collector hood 35 of a conduit system 10 for raising the nodules to the surface. Collector hood 35 is situated between the nodule outlet 27 into chamber 6 and a water inlet 36 through which water may enter the chamber 6 for conveying nodules to the surface through conduit 10. Because the volumetric concentration of the nodules conveyed through conduit 10 may vary substantially, for instance throughout the range of 0 to 20%, it is considered beneficial and in some instances important that the cross-section of water inlet 36 be substantially larger than the cross-section of conduit 10, to insure the availability of a large flow of water through inlet 36.

Persons skilled in the art will readily see that many variations of the foregoing embodiments are possible and are within the scope of the invention and the following claims.

What is claimed is:

1. Apparatus for collecting mineral aggregates from sea beds, including: means to transport said apparatus across and to support it at the surface of the sea bed; means for dislodging aggregates and accompanying silt from the sea bed; adjacent said dislodging means, an inlet leading into a duct including a slowing passage which undergoes a substantial increase in cross-sectional area in the direction in which nodules, silt, and water pass through said duct; means downstream of the slowing passage for separating nodules from the aforementioned stream by causing divergence of silt and nodules into separate paths in which the nodule path is relatively below the silt path; a final outlet by which silt and water depart said apparatus; and means for causing the nodules to depart from the duct upstream of said final outlet.

2. Apparatus for collecting mineral aggregates from sea beds, comprising:

means for supporting said apparatus at the surface of the sea bed for transport across the surface of the sea bed;

a drag shoe member having a leading edge for contacting nodules at a predetermined depth in the sea bed and an upwardly and rearwardly directed inclined surface positioned for lifting said nodules above the sea bed surface;

an enclosed duct including upper, lower and side wall means;

an inlet at the forward end of said duct positioned for direct communication with the water above the sea bed and for receiving a stream including nodules, silt and water elevated by said inclined surface as said apparatus is transported across the sea bed;

turbulence imparting means for inducing said stream to flow turbently in said duct;

a nodule outlet in said duct;

a slowing passage extending downstream of said turbulence imparting means and comprising a portion of said duct which is upstream of said nodule outlet, said slowing passage including divergent walls which provide a cross-sectional area in said duct at said nodule outlet which is substantially larger than the cross-sectional area of said duct at the commencement of said slowing passage; and a silt and water outlet in said duct, downstream of said nodule outlet.

3. Apparatus according to claim 2 wherein said supporting means is a member having a substantially flat bottom adapted to rest on the sea bed.

4. Apparatus according to claim 3 wherein said member has sufficient surface area to resist sinking into the sea bed.

5. Apparatus according to claim 2 including a transporting member extending between said apparatus and a surface vessel, whereby the vessel can pull the unit across the surface of the sea bed.

6. Apparatus according to claim 5 wherein said transporting member is a cable.

7. Apparatus according to claim 2 including means for attaching a transporting member to said apparatus ahead of the center of gravity of said apparatus.

8. Apparatus according to claim 2 wherein said drag shoe is located at the front of said apparatus.

9. Apparatus according to claim 2 wherein said drag shoe extends across the entire width of said inlet.

10. Apparatus according to claim 2 wherein said drag shoe is located forward of the center of gravity of the apparatus.

11. Apparatus according to claim 10 wherein an additional drag shoe is secured to the apparatus rearward of the center of gravity in position for cutting into the sea bed and exerting downward force on the rear of the apparatus for assisting in maintaining it in horizontal position.

12. Apparatus according to claim 2 wherein a portion of said inlet tapers towards the rear of said apparatus.

13. Apparatus according to claim 2 wherein the inlet has a central portion and lateral portions on both sides of said central portion which taper toward the rear of the apparatus.

14. Apparatus according to claim 2 wherein said inlet is entirely above said drag shoe.

15. Apparatus according to claim 3 wherein said inlet is entirely above the portion of said member which rests on the sea bed.

16. Apparatus according to claim 2 wherein said turbulence imparting means includes means for adding velocity to said stream.

17. Apparatus according to claim 2 wherein said turbulence imparting means includes means for projecting fluid into said stream with a downstream component of motion for agitating and propelling said stream.

18. Apparatus according to claim 17 wherein said means for projecting fluid includes nozzle means.

19. Apparatus according to claim 17 wherein said means for projecting fluid is positioned for propelling nodules toward said nodule outlet.

20. Apparatus according to claim 2 wherein said turbulence imparting means is located in said duct.

21. Apparatus according to claim 20 wherein said turbulence imparting means is a transverse array of nozzles at spaced intervals across the interior of the duct adjacent said inlet.

22. Apparatus according to claim 21 wherein said nozzle center lines are directed so as to converge with the bottom wall of said duct toward the downstream end of said duct.

23. Apparatus according to claim 20 wherein said turbulence imparting means is mounted behind a member for protecting said turbulence imparting means from attrition by said nodules.

24. Apparatus according to claim 2 wherein said duct and nodule outlet comprise means for separating silt and nodules into separate paths in which the nodule path is relatively below the silt path.

25. Apparatus according to claim 24 wherein said nodule outlet is turned away from the path of said stream.

26. Apparatus according to claim 2 wherein said nodule outlet is turned downward.

27. Apparatus according to claim 2 wherein said silt and water outlet is turned upward.

28. Apparatus according to claim 2 wherein said slowing passage commences at said inlet.

29. Apparatus according to claim 2 wherein said slowing passage extends to said nodule outlet.

30. Apparatus according to claim 2 wherein said slowing passage extends throughout the entire distance between said turbulence imparting means and said nodule outlet.

31. Apparatus according to claim 2 wherein the side walls in said slowing passage converge in the downstream direction, but the upper and lower walls diverge sufficiently to provide said substantially larger cross-section at said nodule outlet.

32. Apparatus according to claim 2 wherein the cross-sectional area of said slowing passage increases substantially continuously.

33. Apparatus according to claim 32 wherein said increase is linear.

34. Apparatus according to claim 2 wherein said silt and water outlet is of larger cross-sectional area than said inlet.

35. Apparatus according to claim 2 including a nodule collection chamber in communication with said duct through said nodule outlet.

36. Apparatus according to claim 35 wherein said nodule collection chamber is located to the rear of an upward turned portion of said duct.

37. Apparatus according to claim 35 wherein said nodule collection chamber includes a lower wall for supporting nodules, said wall being positioned at a lower elevation than the nodule outlet.

38. Apparatus according to claim 35 wherein a removal conduit for removing nodules from the apparatus has its inlet in said chamber.

39. Apparatus according to claim 38 wherein said nodule collection chamber is provided with a water inlet.

40. Apparatus according to claim 39 wherein said water inlet is of larger cross-sectional area than the inlet of said removal conduit.

41. A method for collecting mineral aggregates from sea beds, including dislodging the aggregates and accompanying silt from the sea bed, introducing a stream of nodules, silt, and water into a duct which undergoes a substantial increase in cross-sectional area in the downstream direction, substantially slowing the velocity of said stream by passing it downstream in said duct, separating nodules from the stream paths in which the nodule path is relatively below the silt path, and causing said nodules to depart from said duct upstream of the final outlet for said silt and water.

42. A method for collecting mineral aggregates from sea beds, comprising;

contacting nodules at a predetermined depth in the sea bed and lifting said nodules above the sea bed surface;

introducing said nodules into the inlet of an enclosed duct having an inlet in direct communication with the water above the sea bed;

forming a stream including said nodules, silt and water which flows in said duct while transporting said duct across the sea bed;

causing said stream to flow turbently in said duct;

removing nodules from said duct through a nodule outlet;

imparting to said stream, in a slowing passage defined by a portion of said duct, a substantially larger cross-sectional area at said nodule outlet than the cross-sectional area of said stream at the commencement of said slowing passage; and removing silt and water from said duct downstream of said nodule outlet.

43. A method according to claim 42 wherein the velocity of said stream is increased in said duct and then slowed in said slowing passage by the impartation of said substantially larger cross-sectional area.

44. A method according to claim 43 wherein turbulence, agitation and added velocity are imparted to said stream by projecting fluid into said stream in said duct upstream of said nodule outlet, with a downstream component of motion.

45. A method according to claim 44 wherein the projected fluid propels said nodules toward said nodule outlet.

46. A method according to claim 42 wherein said silt and nodules are caused to diverge into separate paths in which the nodule path is relatively below the silt path.

47. A method according to claim 42 wherein said substantially larger cross-sectional area is provided by substantially continuously increasing the cross-sectional area of said stream in said slowing passage.

48. A method according to claim 47 wherein said increase is linear.

* * * * *

UNITED STATES PATENT AND TRADEMARK OFFICE

CERTIFICATE OF CORRECTION

PATENT NO. : 4,070,061

DATED : January 24, 1978

INVENTOR(S) : Vsevolod Obolensky

It is certified that error appears in the above-identified patent and that said Letters Patent are hereby corrected as shown below:

Column 6, line 50, after "11." and before "Within" insert --Figure 2 shows surface 32 located below the level of nodule outlet 27.--

Column 10, line 10, claim 42, correct the spelling of "turbently" to read --turbulently--.

Signed and Sealed this

*Twenty-sixth* Day of *February 1980*

[SEAL]

*Attest:*

SIDNEY A. DIAMOND

*Attesting Officer*

*Commissioner of Patents and Trademarks*